United States Patent [19]

Neil

[11] Patent Number: 4,922,816

[45] Date of Patent: May 8, 1990

[54] DOUBLE SHUTTLE DIFFUSION PRINTER

[75] Inventor: Brian K. Neil, Hayden Lake, Id.

[73] Assignee: Advanced Input Devices, Coeur D'Alene, Id.

[21] Appl. No.: 888,646

[22] Filed: Jul. 24, 1986

Related U.S. Application Data

[63] Continuation of Ser. No. 725,924, Apr. 22, 1985, abandoned.

[51] Int. Cl.[5] ..... B41F 17/00

[52] U.S. Cl. ..... 101/41

[58] Field of Search ..... 101/44, 316, 11, 287, 101/41

[56] References Cited

U.S. PATENT DOCUMENTS

| | | | |
|---|---|---|---|
| 84,440 | 11/1868 | Reese | 101/407 BP |
| 402,467 | 4/1889 | McIndoe | 101/11 |
| 894,690 | 7/1908 | Nicklin | 101/407 BP |
| 1,059,657 | 4/1913 | Canine | 101/407 BP |
| 1,106,473 | 8/1914 | Pancoast | 101/287 |
| 1,639,332 | 8/1927 | Edwards | 101/316 |
| 1,788,983 | 1/1931 | Caster | 101/407 BP |
| 1,928,715 | 10/1933 | Wilson | 101/41 |
| 2,356,951 | 8/1944 | Runton | 156/541 |
| 3,283,052 | 11/1966 | Munk | 156/583.1 |
| 3,890,480 | 6/1975 | Berling | 400/490 |

FOREIGN PATENT DOCUMENTS

| | | | |
|---|---|---|---|
| 3014228 | 10/1980 | Fed. Rep. of Germany | 400/120 |
| 2062085 | 6/1971 | France | 101/470 |
| 117661 | 9/1981 | Japan | 101/35 |
| 46900 | 3/1982 | Japan | 101/470 |
| 91089 | 5/1984 | Japan | 101/470 |
| 1196193 | 6/1970 | United Kingdom | 156/583.1 |
| 2120169 | 11/1983 | United Kingdom | 101/470 |

OTHER PUBLICATIONS

Harris; IBM Tech. Disc.; vol. 23, No. 9, Feb. 1981, pp. 4235–4237.

Johnson; IBM Tech. Disc.; vol. 13, No. 7, Dec. 1970, pp. 2041–2042.

*Primary Examiner*—Clifford D. Crowder

*Attorney, Agent, or Firm*—Christensen, O'Connor, Johnson & Kindness

[57] ABSTRACT

A diffusion printer for creating indicia in the top of the keys (67) of a keyboard, such as a computer keyboard (69), is disclosed. The diffusion printer includes a hot stamp press (11) that has a heated, vertically movable platen (15) positioned above a table (13). Mounted on the table is a double tray shuttle (23) whose trays (27) are alternately shuttled between loading positions and a print position located between the platen and the table. Each tray (27) supports a plurality of fixtures (51) each formed to receive a keyboard (69) that includes a plurality of keys (67) to receive indicia. Each fixture (51) includes a fixture base (53) having a plurality of spring loaded pedestals (65). The pedestals are positioned such that a pedestal (65) lies beneath each of the keys (67) to receive indicia. The keys (67) are maintained in a fixed position by a key cap locator plate (55) mounted atop the fixture base (53). The key cap locator plate (55) also functions as a heat shield. Overlying the key cap locator plate (55) is a sheet of transfer paper (81) that includes dry dye crystals in the form of reverse indicia positioned to be alignable with the tops of the keys. Alignment pins (73) are utilized to maintain alignment of the fixture base (53), key cap locator plate (55) and sheet of transfer paper (81). When the fixtures (51) are in the print position, each key is aligned with a key protrusion (87) formed in the bottom of a printing plate (85), which is mounted on the underside of the heated platen (15). When the platen (15) is lowered, the protrusions (87) press the indicia regions of the transfer paper (81) against the keys (67). Because the keys (67) are each backed by a separate spring loaded pedestal (65), uniform platen pressure is applied. The heat produced in the platen is transferred by the printing plate (85) to the indicia paper (81) resulting in the indicia being diffusion printed into the tops of the underlying keys (67).

16 Claims, 6 Drawing Sheets

DOUBLE SHUTTLE DIFFUSION PRINTER

This application is a continuation application based on prior copending application Ser. No. 725,924, filed Apr. 22, 1985, now abandoned.

TECHNICAL AREA

This invention relates to diffusion printing and, more particularly, to the creation of indicia in the tops of the keys of a keyboard by diffusing a dye indicia into the tops.

BACKGROUND OF THE INVENTION

The tops of the keys of many keyboards, such as computer keyboards, bear identifying indicia—letters, numbers, symbols, or a combination thereof. In the past, keyboard indicia have been created by ways that vary from expensive two-shot molding techniques (which create deeply embedded, long wearing indicia) to relatively inexpensive surface printing techniques (which create a surface image that wears away with time and use). Recently, keyboard manufacturers have begun to use wet and dry diffusion printing techniques to create indicia in the tops of the keys. Both techniques have the advantage that they are less expensive that two-shot molding and create infused indicia images whose wear life is considerably greater than surface printed images.

In wet diffusion printing, a dye is transferred from an ink plate to the part using conventional stamping pad equipment. Colors are applied one at a time and the surface of the part that is to receive the dye must be precleaned to insure that no contaminants interfere with the printing process. In addition, the keys must be postcured to set the images. These disadvantages are avoided by dry diffusion printing.

In dry diffusion printing, a transfer paper onto which the image has been preset is pressed against the key that is to receive the indicia. The pressure plus heat results in the dye that forms the indicia image being transferred from the transfer sheet to the key. Image transfer to several keys (including an entire keyboard) can take place simultaneously. Dry diffusion printing requires no prior part cleaning since dye transfer can take place through most surface contaminants. Further, no postcuring is required. In dry diffusion printing, dry dye crystals sublimate upon heated contact with the resin that forms the keys. That is, the dry dye crystals change directly from a solid form into a gas and back into a solid without going through a liquid phase. Attractive forces between the dry dye crystals and the resin molecules "pull" the image into the part. The end result of this migration is a sharp, abrasion-proof image infused to a depth of 4–6 ml. Since dry dye crystals are transferred from a pattern preset on the transfer paper, multicolored images can be transferred in a single step.

In the past, dry diffusion printing machines designed to apply heat and pressure to a sheet of transfer paper to cause the dye crystals that form images to be transferred from the paper to the tops of the keys have been developed. Most such machines currently in use do not print assembled keyboards. Rather only individual keys are printed. Hence, these machines require the labor intensive operation of loading loose keys into a printing fixture prior to printing. After printing, the keys must be removed from the fixture and accurately mounted in a keyboard frame or housing. The repetitive nature of this task makes the probability of error high. The present invention is directed to avoiding these and other problems, and providing a new and improved dry diffusion printing machine that simultaneously prints indicia on the keys of an assembled keyboard.

SUMMARY OF THE INVENTION

In accordance with the invention, a diffusion printer for creating indicia on the tops of the keys of a keyboard, such as a computer keyboard, is provided. The diffusion printer includes a hot stamp presss having a heated platen movable toward and away from a support table. A shuttle is provided for shuttling a tray into and out of the region between the platen and the table. The tray supports one or more fixtures each configured to receive a keyboard that includes a plurality of keys and a frame. Each fixture includes a fixture base having a plurality of spring loaded pedestals positioned such that a pedestal lies beneath each of the keys to be printed when a keyboard is suitably positioned in the fixture base. The tops of the keys are maintained in a fixed position by a key cap locator plate that is mounted atop the fixture base. Overlying the key cap locator plate is a sheet of transfer paper that includes dry dye crystals in the form of reverse indicia positioned to be alignable with the tops of the keys. The locator plate and the transfer paper include alignment holes designed to receive alignment pins extending upwardly from the fixture base. The alignment holes and pins maintain alignment between the fixture base, the locator plate and the transfer paper. After "blank" keyboards are mounted in the fixture bases mounted on the tray, and the locator plate and tranfer paper are mounted and aligned, the tray moves the assembled elements into position between the platen and the table. When suitably positioned, each indicia image, underlying key and backup pedestal is aligned with a key protrusion formed in the bottom of a printing plate mounted on the underside of the heated platen. When the platen is moved toward the table, the protrusions press the indicia images against the keys. Because the keys are each backed by a separate spring loaded pedestal, uniform platen pressure is applied. The heat produced in the platen is transferred via the printing plate to the indicia paper resulting in the indicia images being transferred by diffusion into the tops of the underlying keys. In addition to "locating" the keys, the locator plate also functions as a heat shield that prevents the platen heat from distorting the keyboard frame.

In accordance with further aspects of this invention, the shuttle mechanism includes a pair of trays and a support assembly that allows each tray to be shuttled from a loading position, located outside the region between the platen and the table, and the print position located between the platen and the table. Preferably, the loading positions are located on opposite sides of the platen.

In accordance with other aspects of this invention, the printing plates include locator pins that mesh with locator holes formed in the fixture base when the platen is moved toward the table during printing.

In accordance with still other aspects of this invention, the printing plate is a machined plate and a rubber blanket is located between the printing plate and the underlying fixture base, keyboard, locator plate and indicia transfer paper.

In accordance with alternative principles of this invention, the printing plate is molded and covered with a heat conductive, slightly compressible material, avoiding the need for a rubber blanket between the printing plate and the fixture base, keyboard, locator plate and transfer paper.

As will be readily appreciated from the foregoing description, the invention provides a dry diffusion printing machine that simultaneously prints indicia on the keys of an assembled keyboard. Accurate registration between the indicia images to be transferred to key tops and the key tops that are to receive the images is provided by precisely positioning the key tops and aligning the indicial images with the precisely positioned key tops. Further, uniform pressure is provided by the inclusion of pedestals that apply a separate backup pressure to each of the keys. This, plus providing for a slight amount of shape variation between the printing plate and the keys by using a rubber blanket, or a molded printing plate covered with a heat conductive, slightly compressible material, results in the creation of uniform images in the resulting key tops.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
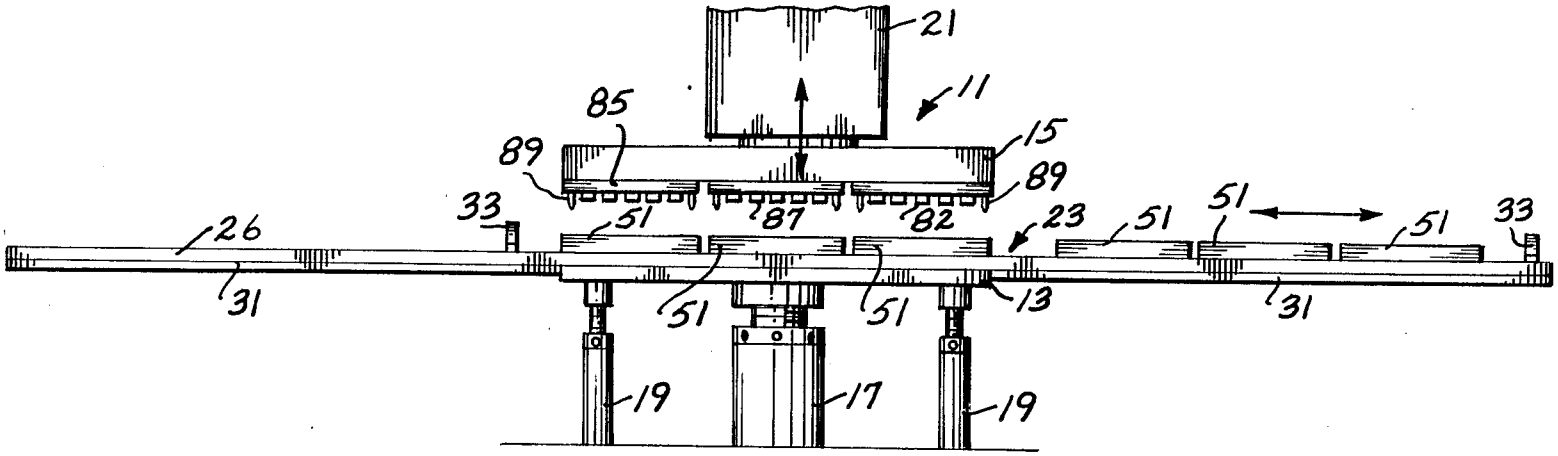
FIG. 1 is a front elevational view of a preferred embodiment of a dry diffusion printer formed in accordance with the invention.
Figure 2:
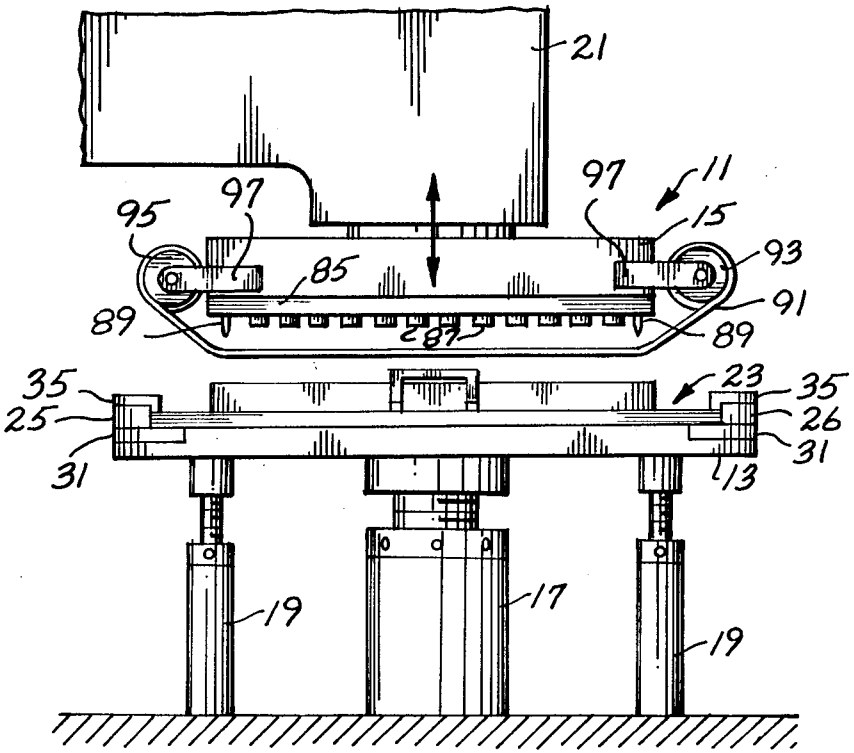
FIG. 2 is a side elevational view of the dry diffusion printer illustrated in FIG. 1.

As illustrated in FIGS. 1 and 2, a preferred embodiment of a dry diffusion printer formed in accordance with the invention comprises a press 11 that includes a table 13 underlying a heated platen 15. The table is supported by a center table support column 17 and outboard table support columns 19. Preferably, the table surface is rectangular and one of the support columns 19 is located at each corner. The center and outboard table support columns 17 and 19 are height adjustable. Preferably, the support pressure applied to the table 13 by the center table support column 17 can be adjusted. The heated platen 15 is mounted on an upper arm 21 and is vertically movable toward and away from the table 13, as shown by the vertical arrows in FIGS. 1 and 2.

While various presses can be used to forman embodiment of the invention, one suitable press is the air operated, ten (10) ton hot stamp press with an 18 inch by 24 inch heated upper platen (0°-800° F.) and a 22 inch by 30 inch table marketed as the KENSOL 65H press by Kensol-Olsenmark, Inc., Melville, N.Y. 11746.

Figure 3:
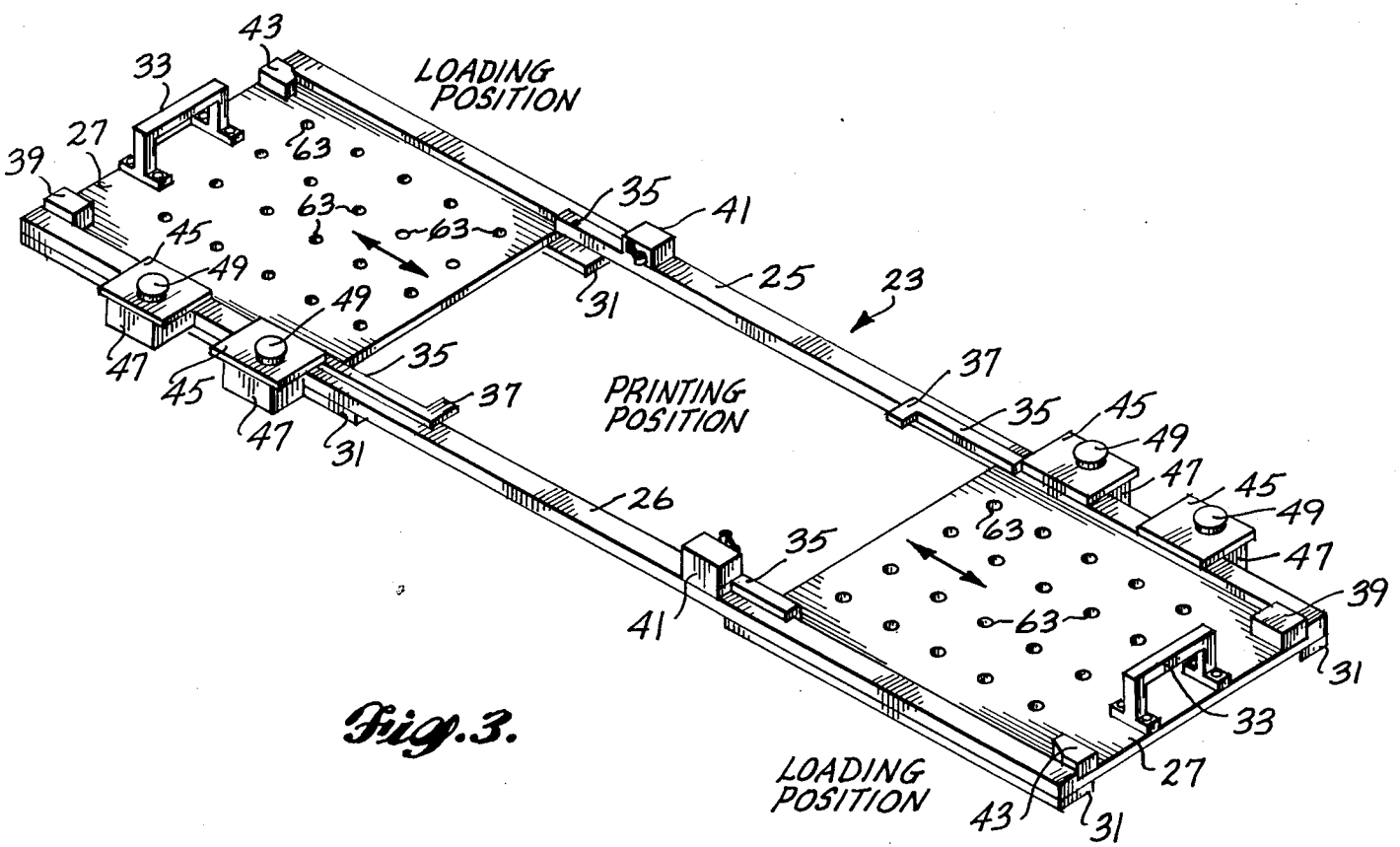
FIG. 3 is a pictorial diagram of a double shuttle suitable for use in a dry diffusion printer formed in accordance with the invention.

Mounted atop and supported by the table 13 is a double tray shuttle 23. As best seen in FIG. 3, the double tray shuttle 23 includes an inboard tray guide 25 and an outboard tray guide 26. The tray guides are elongate and lie parallel to one another. The parallel, elongate tray guides are mounted atop the table 13 adjacent the front and rear edges thereof. The elongate tray guides extend outwardly from opposite sides of the table 13 and are long enough to allow the hereinafter described trays 27 to be rectilinearly movable between a print position and a loading position. In the print position the trays lie between the table 13 and the platen 15. In the loading position the trays lie outboard of the print position. Affixed to the bottom of each of the inboard and outboard tray guides 25 and 26, where they extend beyond the edges of the table 13, are tray support plates 31. The tray support plates 31 are wider than the tray guides and extend toward one another so as to provide a lip on the inner lower edges of the tray guides. The lips support the trays 27 when the trays are in their loading positions. The trays are flat sheets designed to be manually slidable between the loading positions where they are supported by the lips formed by the tray support plates and the printing position where they are supported by the table 13. Mounted atop each of the trays 27, near the outer edge thereof is a handle 33.

Mounted atop the elongate inboard and outboard tray guides 25 and 26, in the region between the loading stations and the printing station, are tray hold downs 35. More specifically, as shown in FIG. 3 the double tray shuttle 23 includes four hold downs 35, two mounted atop each of the inboard and outboard tray guides 25 and 26, one lying between the print position and each of the loading positions. The tray hold downs 35 are elongate and have an L-shaped cross-sectional configuration. As best seen in FIG. 2, the tray hold downs 35 are mounted such that one leg lies atop the related inboard and outboard tray guides 25 and 26 and the other leg extends downwardly along the inside wall of the tray guide, ending just above the plane of the upper surface of the related tray 27. Thus, a slot adequate to allow a tray 27 to slide is formed between the downwardly extending leg of the tray hold downs 35 and the upper surface of the tray support plates 31. the tray hold downs 35 mounted on the inboard tray guide 25 are aligned with the tray hold downs 35 mounted on the outboard tray guide 26.

Located adjacent the end of one of the tray hold downs 35 mounted on the inboard tray guide 25 is a tray stop plate 37. A similar tray stop plate 37 is mounted adjacent the end of the non-aligned (i.e., the catercorner) tray hold down 35 mounted on the outboard tray guide 26. One stop plate 37 interacts with one of the trays 27 and the other stop plate 37 interacts with the other tray 27. More specifically, mounted atop each of the trays 27 near the outer corner thereof aligned with one of the tray stop plates 37 is a stop block 39. When the trays are moved from their loading position to the print position, the stop blocks move with the trays 27 until they impinge on their respective tray stop plates 37. When a stop block 39 impinges on its respective tray stop plate 37, inward movement of the tray 27 ends. At this point, the tray 27 is in the print position.

Mounted atop the inboard and outboard tray guides 25 and 26 near the inside ends of the other tray hold downs 35, i.e., the tray hold downs that are not associated with the tray stop plates 37, are microswitches 41. Thus, a microswitch 41 is located across from each of the tray stop plates 37. The arms of the microswitches 41 extend outwardly so as to overlie the path of travel of one of the trays 27. Mounted on the outside corner of each of the trays 27 in alignment with the arm of a related one of the microswitches 41 is a switch actuator block 43. As the trays are moved inwardly from the loading position to the print position, the switch actuator blocks 43 are moved toward the actuator arm of their respective microswitch 41. When a tray is in the print position, the switch actuator block 43 mounted on the tray impinges on the actuator arm of the related microswitch 41. Such impingement closes (or opens depending upon the nonimpingement state of the microswitches) the microswitch to provide an indication that a tray 27 is in the print position.

Mounted atop the inboard and outboard tray guides 25 and 26 are four switch support plates, two mounted on the inboard tray guide 25 and two mounted on the outboard tray guide 26. The switch support plates 45 are positioned such that the pair of switch support plates 45 mounted on the inboard tray guide 25 are located at one loading position and the pair of switch support plates 45 mounted on the outboard tray guide 26 are located at the other loading position. Each of the switch support plates 45 supports a switch 47 that is actuated by a large button 49 that lies above the upper surface of the related switch support plate 45. One of the pairs of switches 47 located at each of the loading positions is a start switch and the other is an emergency stop switch. After a tray is moved to the print position, the related start switch is actuated by pressing its button 49. If the related microswitch 41 is closed the hereinafter described printing cycle takes place. If a dangerous or undesirable situation occurs during the printing cycle, the button 49 of the stop switch is pressed. Actuation of a stop switch causes the platen to immediately raise, which allows the tray and its associated components to be removed from between the platen 15 and the table 13, i.e., from the print position.

Figure 4:
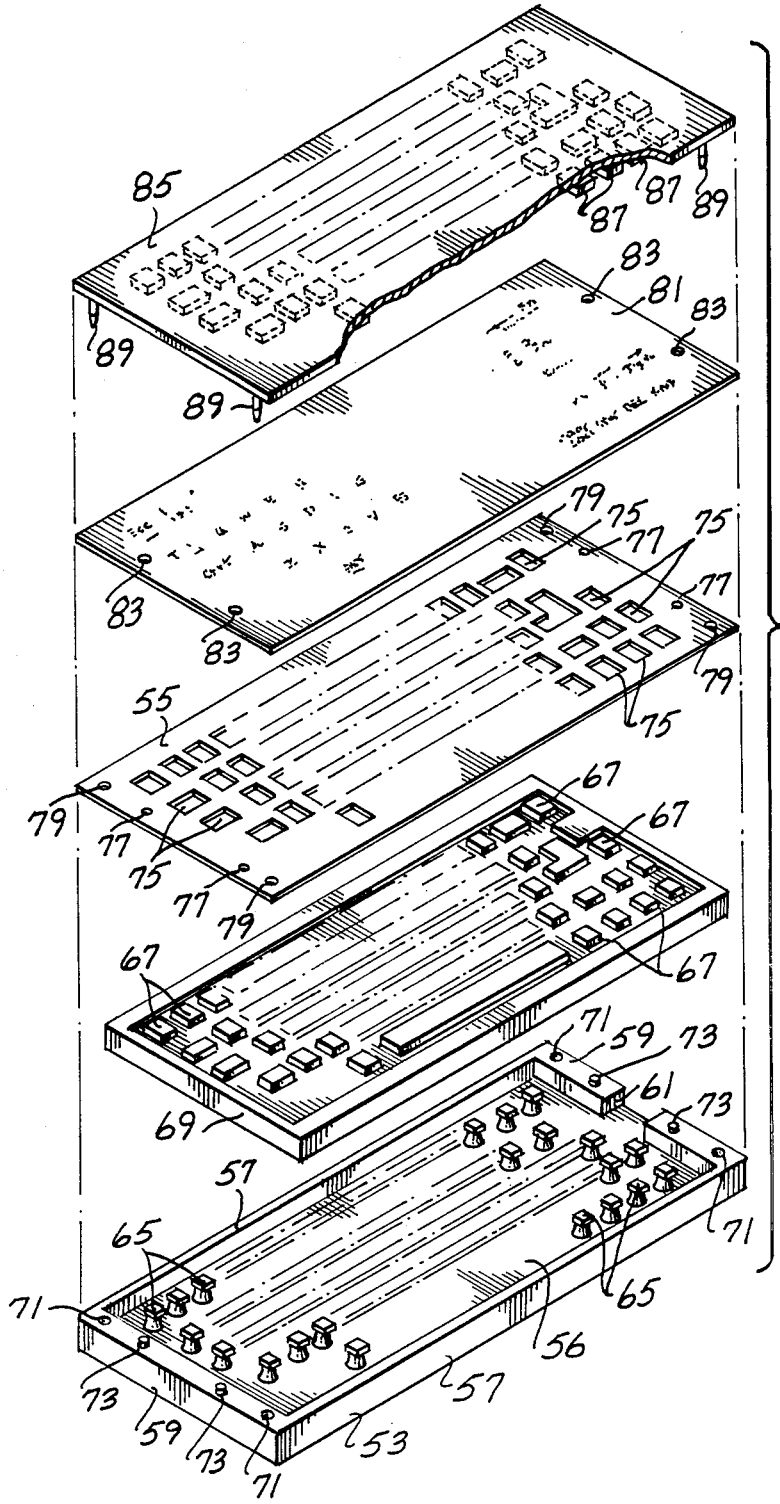
FIG. 4 is an exploded view of a base fixture, keyboard, locator plate, indicia transfer paper and printing plate assembly formed in accordance with the invention.

As illustrated in FIGS. 1 and 2, each of the trays 27 supports at least one, and preferbly several, fixtures 51. In the illustrated embodiment of the invention, each tray supports three fixtures 51. As illustrated best in FIG. 4, each fixture 51 includes a fixture base 53 and a key cap locator plate 55. The fixture base 53 is in the form of an open topped tray that includes a bottom 56, a pair of sidewalls 57 and a pair of end walls 59, one of which may include an access cutout 61. The bottoms 56 of the fixture bases 53 are attached to the related tray 27 in precise positions while various attachment mechanisms can be used, one uncomplicated acceptable attachment mechanism comprises bolts (not shown) mounted in holes (also not shown) formed in the bottoms 56 of the fixture bases 53 and threaded into holes 63 formed in the trays 27.

Attached to the bottom 56 of each of the fixture bases 53 are a plurality of spring loaded pedestals 65. The pedestals are positioned so as to be aligned with the keys 67 of a keyboard 69 that are to receive indicia during the printing sequence, when the keyboard 69 is mounted in the fixture base 53. Preferably, each spring loaded pedestal includes a flat cap mounted atop a coil spring that is attached to the bottom 56 of the fixture base 53.

The fixture base 53 is formed of a suitable high temperature material, such as a high temperature plastic—a phenolic resin based plastic, for example. Formed in the top of the end wall 59 of the fixture base 53, near the ends thereof, are vertical guide holes 71. Extending upwardly from the tops of the ends walls 59, inward of the vertical guide holes 71, are alignment pins 73.

After a keyboard 69 is mounted in a fixture base 53 such that it is surrounded by the sidewalls 57 and the end walls 59 and such that the spring loaded pedestals 65 impinge on the bottoms of the keys 67 to receive indicia, the key cap locator plate 55 is positioned atop the side and end walls. The key cap locator plate 55 is formed of a stiff, rectangular sheet of poor heat conductive material (such as fiberglass or Bakelite) that includes holes 75 positioned and sized to receive and surround each of the keys 67 to receive indicia. Located along the edges of the key cap locator plate 55 are alignment pin holes 77 positioned and sized to receive the alignment pins 73 that extend upwardly from the end walls 59 of the fixture base 53. When the key cap locator plate is positioned atop the side and end walls 57 and 59 of the fixture base 53 such that the pins 73 of the fixture base 53 pass through the pin alignment holes 77 formed in the edge of the key cap locator plate 55, the keys 67 are precisely positioned. Located in the corners of the key cap locator plate 55 so as to be alignable with the alignment holes 71 located in the corners of the fixture base 53 are locator plate alignment holes 79.

Figure 5:
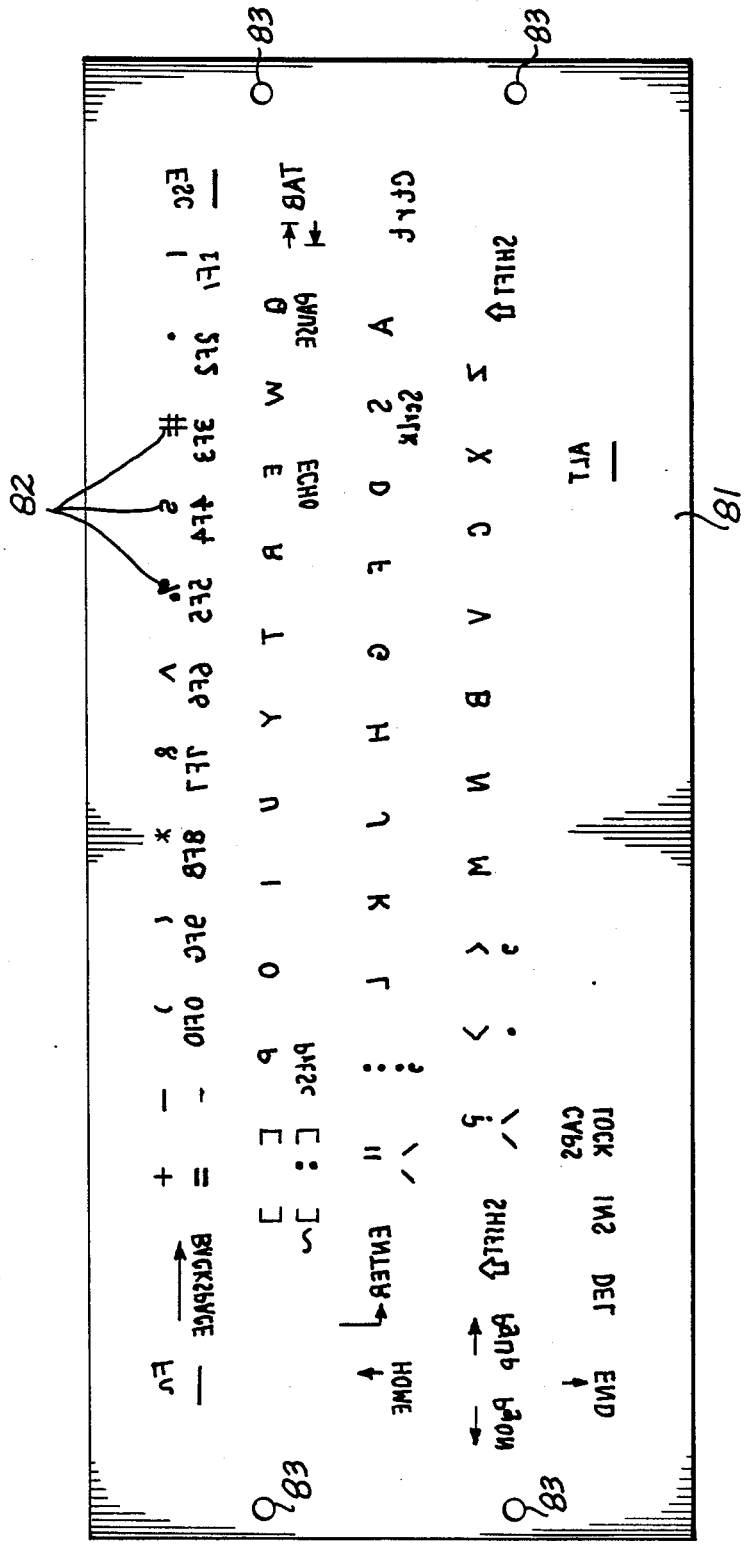
FIG. 5 is a pictorial view of the dye side of a transfer paper suitable for use in a dry diffusion printer formed in accordance with the invention.
Figure 6:
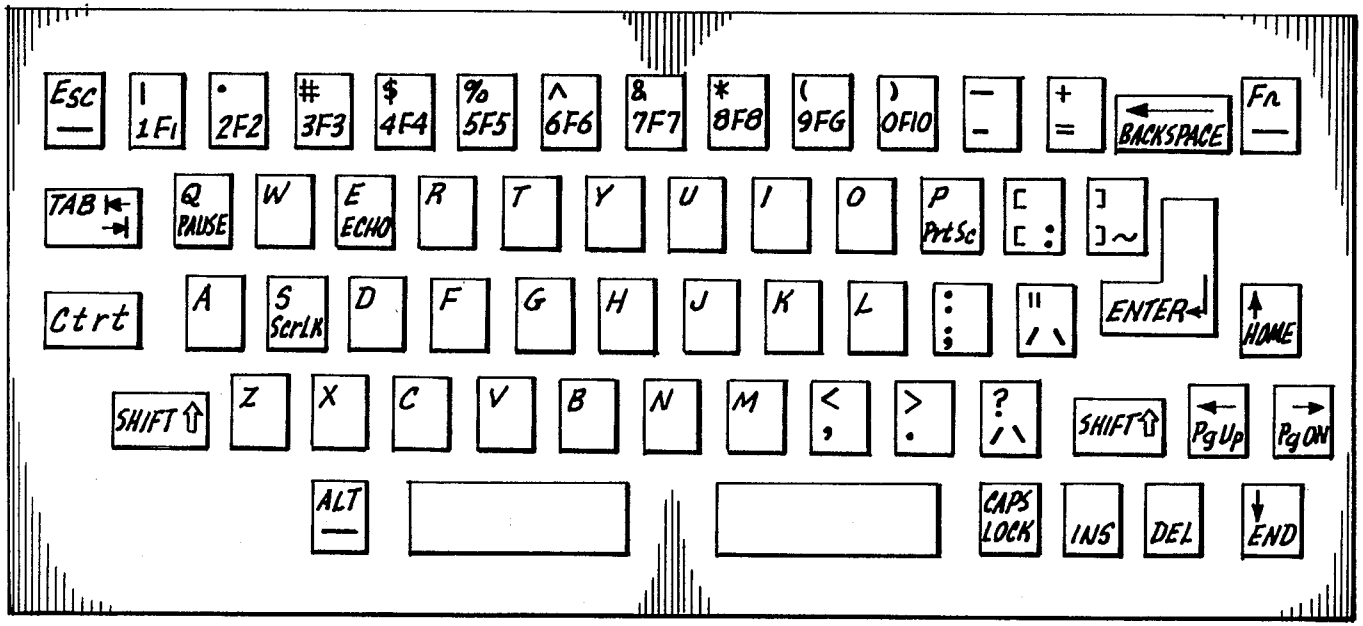
FIG. 6 is a pictorial view showing the indicia on the keys of a keyboard created by a dry diffusion printer formed in accordance with the invention utilizing an indicia transfer paper of the type illustrated in FIG. 5.

Positioned above the fixture formed by the fixture base 53 and the key cap locator plate 55 is a sheet of transfer paper 81. As best illustrated in FIG. 5, the sheet of transfer paper 81 is rectangular and includes a plurality of precisely positioned dry dye indicia 82 that are reverse of the indicia to be created on the keys 67 of the keyboard 69. Alignment of the transfer paper 81 is accomplished by positioning the transfer paper 81 such that the alignment pins 73 that extend upwardly from the end walls 59 of the fixture base 53 pass through alignment holes 83 located along the edge of the transfer paper.

Under pressure and heat, the dry dyes held by the transfer paper sublimate. That is, the dry dyes change directly from a solid form to a gas and back into a solid again without going through a liquid stage. Attractive forces between the dye and the resin molecules of the keys "pull" the image into the keys to a depth of 4–6 mils. As a result images are printed by the diffusion of the dye into the keys.

Heat and pressue are applied to the transfer paper and the keys to cause diffusion printing by the platen 15 of the press 11 via printing plates 85 mounted on the bottom of the platen 15. In the illustrated embodiment of the invention a printing plate 85 is associated with each fixture base 53. The printing plates 85 are formed of a flat, thick sheet of heat conducting material, such as aluminum or steel. Projecting outwardly from the bottom surface of the printing plates 85 are a plurality of protrusions 87, one positioned to be aligned with each of the keys 67 to receive an indicia from the transfer paper 81. The protrusions may be formed by the precise machining of the printing plate material. Located in each of the corners of the printing plates 85 are leader pins 89. The leader pins 89 are positioned so as to be alignble with the vertical alignment holes 71 formed in the end walls 59 of a fixture base 53 when a fixture base is suitably aligned beneath a printing plate 85.

Located between the printing plate protrusions 87 and the transfer paper 81 is a rubber blanket 91 (FIG. 2). The rubber blanket, which may be formed of 1/32 inch silicone rubber, runs from a feed roller 93 located on one side of the platen 15 to a take-up roller 95 located on the other side of the platen. The supply and take-up rollers 93 and 94 are supported by arms 97 that extend horizontally outwardly from the sides of the platen 15. The rubber blanket compensates for any slight irregularities in the face of the printing plate protrusions 87. The rubber blanket also provides a renewable clean surface that is used to avoid the printing contamination that would occur as a result of the dye particles collected by the blanket during printing.

In operation, after the fixtue bases 53 have been attached to the trays 27, each fixture base is filled with a keyboard 67. After the keyboards 67 have been suitably positioned in their related fixture bases 53, a key cap locator plate 55 is mounted atop ech of the fixture bases 53 in the manner heretofore described, i.e., such that each key to be imprinted passes through a locator hole 75 in the key cap locator plate and such that the alignment pins 73 formed in the end walls 59 of the fixture bases 53 pass through the alignment holes 77 formed in the key cap locator plate. Thereafter, a sheet of transfer paper 81 is laid face down atop each of the key cap locator plates 55 such that the alignment pins 73 formed in end walls 59 of the fixture base 53 pass through the transfer paper alignment holes 83 and such that the appropriate indicia dyes are aligned with the keys that are to receive the dye images.

Next, the tray with the filled fixture bases is pushed from its loading position to the printing position located between the platen 15 and the table 13. As previously described, when the tray reaches the printing position, its stop block 39 impinges on a stop plate 37 and the related microswitch 41 is closed by a switch actuator block 43. Thereafter, the button 49 of a start switch 47 is depressed causing the platen to be lowered. As the platen lowers, the leader pins formed in the printing plates 85 enter the vertical alignment holes 71 formed in the end walls 59 of the fixture bases 53. Then, the printing plate protrusions 87 press the image areas of the transfer paper 81 against the underlying keys 67. The pressure supplied by the platen plus the heat of the printing plate causes the dyes to sublimate and their images to transfer to the keys. The transfer keys may be heated to 380°–410° F. and the platen may press the transfer paper against the keys with a 1–2 psi force for 30 seconds, for example, under the control of a suitable controller (not shown). In addition to locating the keys during printing, the key cap locator plate 55 functions as a heat shield that prevents the heat produced by the platen from warping the housing in which the keys are mounted.

After the printing cycle has timed out, the platen is automatically raised. Thereafter, the operator returns the tray bearing the printed keyboards to its loading position, after which the transfer paper and the key cap locator plate are raised and the keyboards are removed. The double tray shuttle 23 allows an operator to be filling the fixture bases of one tray while the other tray is in the printing position, resulting in an increase in throughput over that achievable using a single tray shuttle.

In summary, the invention provides a double shuttle diffusion printer that includes key cap locator plates that precisely position the key caps of a keyboard mounted in a fixture base. Precise positioning of transfer paper placed atop the key cap locator plate is also provided. The precisely positioned assemblage of components is mounted atop a tray that is located at a loading station while another tray is located at a printing station. After printing is completed, the tray at the printing station is removed from the printing station and the tray at the loading station is moved to the printing station. Thereafter, a heated, precisely machined, printing plate is pressed tightly against the transfer paper through a thin, silicone rubber blanket. While dwelling in this printing position for a specified period of time, temperature and pressure causes the transfer paper dye to sublimate and penetrate into the top surface of the underlying keys. As a result, the indicia is formed in the key tops to a nominal depth. Because the keys are backed by spring loaded supports, individual compensation required by variation in part size is automatically compensated for. Further, the double shuttle concept allows economies of operation not achievable with other printers.

While a preferred embodiment of the invention has been illustrated and described, it will be appreciated that various changes can be made therein without departing from the spirit and scope of the invention. For example, shuttle movement between the loading and printing positions can be performed mechanically, rather than manually as illustrated and described. Further, rather than using a precisely machined printing plate and an underlying rubber blanket, the printing plate can be molded and covered with a layer of protective material. More specifically, an alternative printing plte can be molded from ⅛ inch steel plate and the protrusion surface of the molded plate covered with a blend of catalyzed high temperature silicone rubber and finely divided aluminum powder. The aluminum powder is added to enhance conductivity. A suitable silicone rubber/aluminum powder blend ratio is 35:65. The silicone rubber/aluminum powder blend is made to adhere to the steel plate by suitably priming the plate and by mechanically attaching the blend to the plate. One suitable way of mechanical attachment is to drill many small holes in the plate and countersink the back side of the holes. The fluid silicone rubber/aluminum powder blend, which flows through the holes and into the countersinks when applied, acts like rivets after the blend is cured. Consequently, the invention can be practiced otherwise than is specifically described herein.

What is claimed is:

1. A diffusion printer for creating indicia in the tops of the assembled keys of a keyboard comprising:

(A) a hot stamp press including a support table and a vertically movable, heated platen mounted above said support table;

(B) shuttle means for shuttling a tray between a loading position located outside of the region between said platen and said support table and a printing position located in the region between said platen and said support plate;

(C) at least one fixture mounted on said tray, said at least one fixture comprising:

(1) a fixture base for receiving a keyboard including assembled blank keys that are to receive indicia, said fixture base including compression means located beneath and aligned with said keys that are to receive indicia for applying irregularity compensation pressure separately to the bottoms of said keys; and, (2) a locator plate mounted on said fixture base for surrounding and maintaining alignment of the surfaces of said keys that are to receive indicia;

(D) transfer paper means situated atop said keys, said transfer paper means including indicia images formed of dry dye suitable for diffusion printing into said keys under heat and pressure, each of said dry dye indicia images positioned in alignment with the top surface of a respective one of said keys that are to receive indicia; and, (E) a printing plate attached to the bottom of said heated platen for transferring heat from said heated platen to said transfer paper means and said keys that are to receive indicia when said heated platen is lowered, said printing plate including a plurality of rigid protrusions, each of said rigid protrusions positioned so as to be alignable with the top surface of a respective one of the keys that are to receive indicia of a keyboard mounted in said fixture base when said shuttle moves said tray to said printing position between said platen and said support table and press said transfer paper against said top surface of said keys that are to receive indicia when said heated platen is lowered.

2. A diffusion printer as claimed in claim 1, wherein said compression means comprises a plurality of spring loaded pedestals, one of said pedestals positioned so as to be alignable with each of said keys that is to receive indicia.

3. A diffusion printer as claimed in claim 2, wherein said fixture base includes a bottom and sidewalls and wherein said spring loaded pedestals are mounted on the bottom of said fixture base.

4. A diffusion printer as claimed in claim 3, wherein the tops of the walls of said fixture base and the edge of said locator plate include alignment means that coact together to align said locator plate atop said fixture base.

5. A diffusion printed as claimed in claim 4, wherein said transfer paper includes locator means that coact with the locator means of said fixture base and said locator plate to align said images on said transfer paper with said keys that are to receive said indicia.

6. A diffusion printer as claimed in claim 5, wherein said shuttle means is a double tray shuttle.

7. A diffusion printer as claimed in claim 6, wherein said double tray shuttle comprises a track and a pair of trays, said track passing through said printing position located in the region between said platen and said support table, said trays movable in said track from loading positions located on opposite sides of said printing position to said printing position located between said platen and said support table.

8. A diffusion printer as claimed in claim 7, wherein said printing plate includes locator pins and wherein said fixture base includes locator holes suitable for receiving said locator pins.

9. A diffusion printer as claimed in claim 1, wherein said printing plate is a machine plate and including a rubber blanket located between said printing plate protrusions and said fixture base, keyboard, locator plate and indicia transfer paper when a tray bearing said fixture base, keyboard, locator plate and indicia transfer paper is in said printing position located between said plate and said support table.

10. A diffusion printer as claimed in claim 9, wherein said compression mens comprises a plurality of spring loaded pedestals, one of said pedestals positioned so as to be alignable with each of said keys that is to receive indicia.

11. A diffusion printer as claimed in claim 10, wherein said fixture base includes a bottom and sidewalls and wherein said spring loaded pedestals are mounted on the bottom of said fixture base.

12. A diffusion printer as claimed in claim 11, wherein the tops of the walls of said fixture base and the edge of said locator plate include alignment means that coact together to align said locator plate atop said fixture base.

13. A diffusion printer as claimed in claim 12, wherein said transfer paper includes locator means that coact with the locator means of said fixture base and said locator plate to align said images on said transfer paper with said keys that are to receive said indicia.

14. A diffusion printer as claimed in claim 13, wherein said shuttle means is a double tray shuttle.

15. A diffusion printer as claimed in claim 14, wherein said double tray shuttle comprises a track and a pair of trays, said track passing through said printing position located in the region between said platen and said support table, said trays movable in said track from loading positions located on opposite sides of said printing position to said printing position located between said platen and said support table.

16. A diffusion printer as claimed in claim 15, wherein said printing plate includes locator pins and wherein said fixture base includes locator holes suitable for receiving said locator pins.

* * * * *

UNITED STATES PATENT AND TRADEMARK OFFICE

CERTIFICATE OF CORRECTION

PATENT NO. : 4,922,816

DATED : May 8, 1990

INVENTOR(S) : Brian K. Neil

It is certified that error appears in the above-identified patent and that said Letters Patent is hereby corrected as shown below:

| Column | Line | |
|---|---|---|
| 1 | 26 | Delete "that" (second occurrence) and insert therefor --than-- |
| 3 | 65 | Delete "forman" and insert therefor --form an-- |
| 4 | 46 | Delete "the" (second occurrence) and insert therefor --The-- |
| 6 | 32 | After "reverse" insert --images-- |
| 6 | 47 | Delete "pressue" and insert therefor --pressure-- |
| 6 | 62 | Delete "alignble" and insert therefor --alignable-- |
| 7 | 3 | Delete "94" and insert therefor --95-- |
| 7 | 11 | Delete "fixtue" and insert therefor --fixture-- |
| 8 | 29 | Delete "plte" and insert therefor --plate-- |

Signed and Sealed this

Thirty-first Day of March, 1992

*Attest:*

HARRY F. MANBECK, JR.

*Attesting Officer*

*Commissioner of Patents and Trademarks*